US008263893B2

(12) United States Patent
Rønhovd

(10) Patent No.: US 8,263,893 B2
(45) Date of Patent: Sep. 11, 2012

(54) SUBSEA ARRANGEMENT

(75) Inventor: Tor-Odd Rønhovd, Bergen (NO)

(73) Assignee: Vetco Gray Scandinavia AS, Sandvika (NO)

( * ) Notice: Subject to any disclaimer, the term of this patent is extended or adjusted under 35 U.S.C. 154(b) by 815 days.

(21) Appl. No.: 12/307,364

(22) PCT Filed: Jul. 4, 2007

(86) PCT No.: PCT/IB2007/001832

§ 371 (c)(1),
(2), (4) Date: Jan. 5, 2009

(87) PCT Pub. No.: WO2008/004086

PCT Pub. Date: Jan. 10, 2008

(65) Prior Publication Data

US 2009/0289038 A1 Nov. 26, 2009

(30) Foreign Application Priority Data

Jul. 5, 2006 (NO) ..... 20063122

(51) Int. Cl.
*H01H 35/24* (2006.01)

(52) U.S. Cl. ..... 218/120; 417/414

(58) Field of Classification Search ..... 218/2–7, 218/14, 59, 78, 84, 92, 93, 153–155; 361/600–605, 361/612, 613, 618–621, 631, 632, 635, 643, 361/652; 200/81 R, 81.4, 81.5, 82 R, 82 B
See application file for complete search history.

(56) References Cited

U.S. PATENT DOCUMENTS

| | | | | |
|---|---|---|---|---|
| 2,911,919 | A | 11/1959 | Tucker | |
| 4,324,534 | A | 4/1982 | Sharkey | |
| 6,867,364 | B2 * | 3/2005 | Hafskjold et al. | 174/50 |
| 7,045,912 | B2 * | 5/2006 | Leijon et al. | 290/42 |
| 7,247,804 | B2 | 7/2007 | Eriksson et al. | |
| 7,952,855 | B2 * | 5/2011 | Sletten et al. | 361/618 |
| 2004/0149446 | A1 * | 8/2004 | Appleford et al. | 166/366 |

FOREIGN PATENT DOCUMENTS

| | | |
|---|---|---|
| GB | 1404652 | 9/1975 |
| NO | 321080 | 3/2006 |
| WO | WO 02/41336 | 5/2002 |

(Continued)

OTHER PUBLICATIONS

International Search Report—Nov. 26, 2007.

(Continued)

*Primary Examiner* — Amy Cohen Johnson
*Assistant Examiner* — Marina Fishman
(74) *Attorney, Agent, or Firm* — Venable LLP; Eric J. Franklin

(57) ABSTRACT

A subsea arrangement including at least one canister including a chamber accommodating at least one circuit breaker. The chamber is filled with a gaseous dielectric medium constituting a quenching medium for the at least one circuit breaker in the chamber. The pressure in the chamber is balanced against ambient sea water pressure by a pressure balancer, which includes at least one pressure container containing a pressurized gaseous medium of a same type as the gaseous medium in the chamber. The pressure container is connected to the chamber via a control valve, which is arranged to be controlled by the ambient pressure so as to feed pressurized gaseous medium from the pressure container into the chamber when the ambient pressure increases in order to maintain the pressure in the chamber equal to the ambient pressure.

10 Claims, 1 Drawing Sheet

FOREIGN PATENT DOCUMENTS

WO WO 02/093715 11/2002

OTHER PUBLICATIONS

International Preliminary Report on Patentability—Oct. 6, 2008.
Norwegian Search Report—Jan. 31, 2007.
Sølvik et al., Controlled subsea electric power distribution with SEPDIS, ABB Review, No. 2, 2000.
R. Strømquist, Enablers for deep water & long tie backs, DnV INTSOK, Deep water expert workshop, Aug. 30, 2005.

* cited by examiner

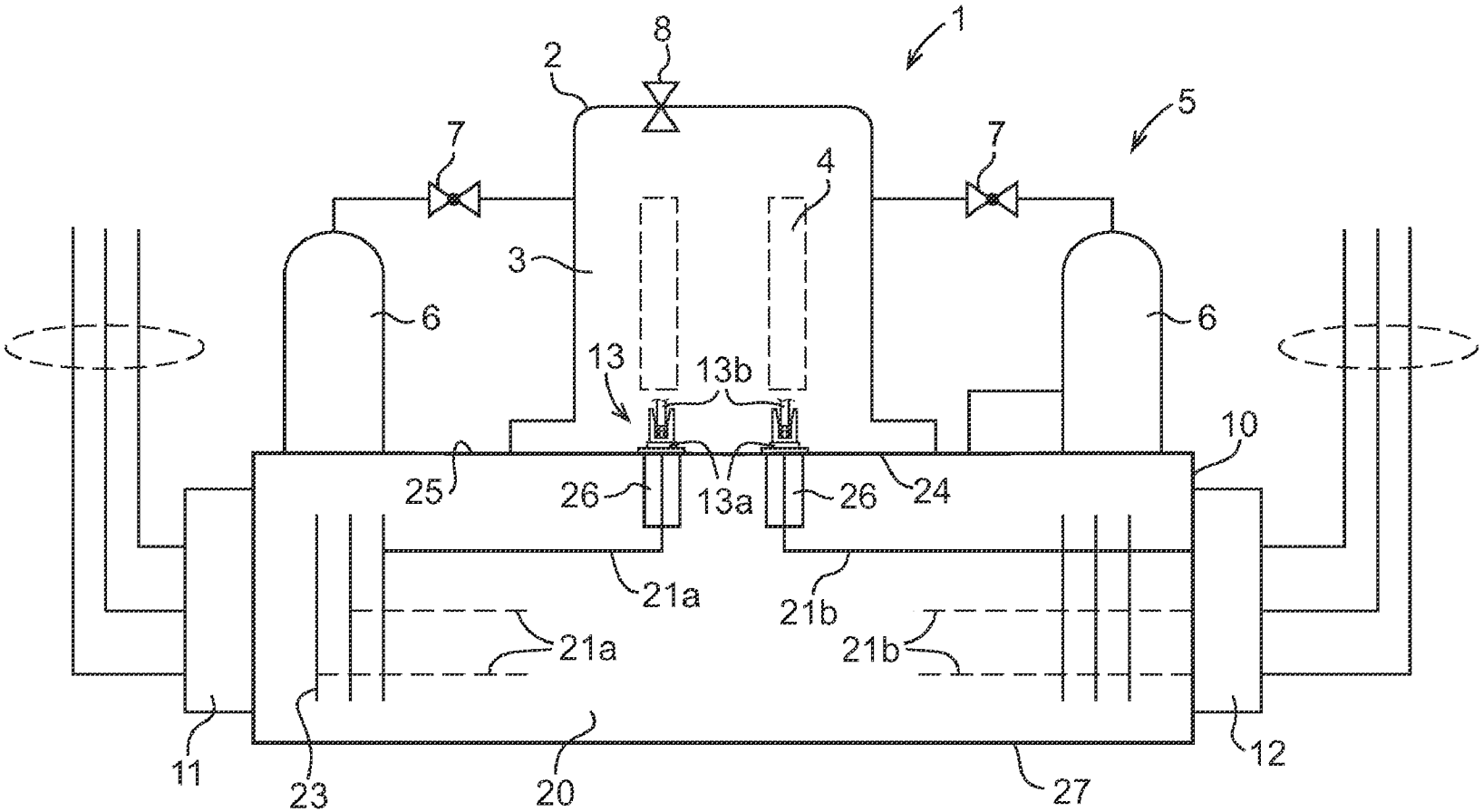
1
2
3
4
5
6
6
7
7
8
10
11
12
13
13a
13b
20
21a
21a
21b
21b
23
24
25
26
26
27

SUBSEA ARRANGEMENT

CROSS-REFERENCE TO RELATED APPLICATIONS

This application claims priority to Norwegian patent application 20063122 filed 5 Jul. 2006 and is the national phase under 35 U.S.C. §371 of PCT/IB2007/001832 filed 4 Jul. 2007.

FIELD OF THE INVENTION AND PRIOR ART

The present invention relates to a subsea arrangement according to the preamble of claim 1.

The inventive subsea arrangement is intended for accommodating a circuit breaker that is to be used for subsea applications. Application areas are typically in a subsea plant for extraction and/or processing of well fluid in the form of oil and/or natural gas from a subsea well where electrical power is needed and for offshore power generation. A circuit breaker for subsea use is normally accommodated in a pressure vessel.

SUMMARY OF THE INVENTION

The object of the present invention is to provide a subsea arrangement of the above-indicated type, which is well-suited for use at great sea depths.

The inventive subsea arrangement comprises:

at least one canister, which comprises a chamber accommodating at least one circuit breaker, and pressure balancing means for balancing the pressure in said chamber against ambient sea water pressure, and is characterized in:

that said chamber is filled with a gaseous dielectric medium constituting the quenching medium for the circuit breaker or circuit breakers in the chamber; and that the pressure balancing means comprises at least one pressure container containing a pressurized gaseous medium of the same type as the gaseous medium in said chamber, the pressure container being connected to said chamber via a control valve, which is arranged to be controlled by the ambient pressure so as to feed pressurized gaseous medium from the pressure container into the chamber when the ambient pressure increases in order to maintain the pressure in the chamber equal to the ambient pressure.

The internal pressure of the canister is consequently adjusted so as to correspond to the pressure of the ambient sea water at the depth where the subsea arrangement is located. Hereby, the canister does not have to be designed as a pressure vessel, which implies lower constructional demands and costs for the canister. The dielectric properties of dielectric gas increase as the pressure of the dielectric gas increases. Thus, the increased pressure imposed by the water depth will in this case have a good effect on the dielectric properties of the dielectric gas surrounding the circuit breaker or circuit breakers in the canister. Hereby, the volume of the chamber accommodating the circuit breaker or circuit breakers may be reduced, which makes possible a very compact construction of the subsea arrangement and thereby substantial cost reductions. Furthermore, dielectric gas is maintenance free and its cooling properties increases with increasing ambient pressure. The use of pressurized gaseous medium in one or several pressure containers for achieving the desired pressure balancing of the gaseous dielectric medium in the chamber accommodating the circuit breaker or circuit breakers will make it possible to balance the pressure in the chamber in a convenient manner against ambient sea water pressure at very great sea depths, for instance at a sea depth of about 1500-2000 meters.

Further advantages as well as advantageous features of the inventive subsea arrangement will appear from the following description.

BRIEF DESCRIPTION OF THE DRAWING

With reference to the appended drawing, a specific description of preferred embodiments of the invention cited as examples follows below. In the drawing:

FIG. 1 is a schematic illustration of a subsea arrangement according to an embodiment of the present invention.

DETAILED DESCRIPTION OF PREFERRED EMBODIMENTS OF THE INVENTION

FIG. 1 illustrates very schematically a subsea arrangement 1 according to an embodiment of the invention. The illustrated subsea arrangement 1 comprises a canister 2, which comprises a chamber 3 accommodating at least one high voltage circuit breaker 4.

The chamber 3 is filled with a gaseous dielectric medium and pressure balanced against ambient sea water pressure. The gaseous dielectric medium constitutes the quenching medium for the circuit breaker 4 in the chamber 3. The pressure balancing of the chamber 3 is accomplished by means of pressure balancing means 5 which comprises at least one pressure container 6 containing a pressurized gaseous medium of the same type as the gaseous medium in the chamber 3. The respective pressure container 6 is connected to the chamber 3 via a control valve 7, which is arranged to be controlled by the ambient sea water pressure so as to feed pressurized gaseous medium from the pressure container 6 into the chamber 3 when the ambient pressure increases in order to maintain the pressure in the chamber 3 equal to the ambient pressure. When the subsea arrangement 1 is lowered towards the seabed, the external water pressure on the canister 2 will increase and the respective control valve 7 will release pressurized gaseous medium from the associated pressure container 6 into the chamber 3 so as to thereby increase the pressure in the chamber 3 and compensate for the water pressure acting on the canister 2.

In the illustrated example, said pressure balancing means 5 comprises two pressure containers 6 of the above-mentioned type. The respective pressure container 6 is connected to the chamber 3 via a respective control valve 7, which is directly controlled by the ambient pressure so as to control the supply of pressurized gaseous medium from the associated pressure container 6 into the canister chamber 3 in dependence on the ambient pressure.

A pressure relief valve 8 is preferably fitted in the wall of the canister to enable release of excess pressure from the chamber 3 when the subsea arrangement 1 is to be retrieved to the surface, for example for maintenance or repair or if the deployment operation is aborted. The canister 2 may be a soft tank.

The gaseous dielectric medium in the chamber 3 and in the respective pressure container 6 may for instance be nitrogen or a mixture of nitrogen and $SF_6$.

The subsea arrangement 1 illustrated in FIG. 1 comprises a frame 10 having an electrical power inlet 11 and an electrical power outlet 12. The respective circuit breaker 4 accommodated in the chamber 3 is electrically connected to the power inlet 11 and power outlet 12 via a coupling arrangement 13 having a first part 13*a* secured to the frame 10 and a second part 13*b* secured to the circuit breaker 4. Said second part 13*b* is releasably connectable to said first part 13*a* so as to allow the canister 2 together with its circuit breaker 4 or circuit breakers to be releasably mounted to the frame 10.

In the embodiment illustrated in FIG. 1, the frame 10 comprises a distribution chamber 20, said coupling arrangement 13 being electrically connected to the associated power inlet 11 and power outlet 12 via electrical current connections 21*a*, 21*b* extending through the distribution chamber 20. In the embodiment of FIG. 1, busbars 23 are also arranged in the distribution chamber 20 in order to distribute the power from the power input 11 to the associated electrical connections 21*a*. The chamber 3 of the canister 2 is separated from the distribution chamber 20 by a zero differential pressure barrier 24 when the canister is mounted to the frame 10. This zero differential pressure barrier 24 here forms part of the upper wall 25 of the distribution chamber.

The distribution chamber 20 is filled with a dielectric medium, preferably in the form of oil. The distribution chamber 20 is with advantage volume compensated to the ambient sea in a suitable manner. Furthermore, the distribution chamber 20 is with advantage pressure balanced against ambient sea water pressure in a suitable manner. This implies that the distribution chamber 20 may be housed in a soft tank 27. Different types of volume compensating means and pressure balancing means that are suitable for subsea use and that may be used for the oil-filled distribution chamber 20 are well known to persons skilled in the art and will therefore not be more closely described is this description. The bushings 26 between the distribution chamber 20 and the canister chamber 3 may be high voltage oil/gas bushings of standard industrial type since the differential pressure between the distribution chamber 20 and the canister chamber 3 equals zero. This eliminates possible technology gaps related to high voltage bushings for pressure containers and offers cost effective design as compared to traditional standard pressure vessels.

The invention is of course not in any way restricted to the embodiments described above. On the contrary, many possibilities to modifications thereof will be apparent to a person with ordinary skill in the art without departing from the basic idea of the invention such as defined in the appended claims.

The invention claimed is:

1. A subsea arrangement, comprising:

at least one canister comprising a chamber accommodating at least one circuit breaker, and a pressure balancer for balancing a pressure in said chamber against ambient sea water pressure, wherein said chamber is filled with a gaseous dielectric medium constituting a quenching medium for the at least one circuit breaker in the chamber; and wherein the pressure balancer comprises at least one pressure container containing a pressurized gaseous medium of a same type as the gaseous medium in said chamber, the pressure container being connected to said chamber via a control valve, which is arranged to be controlled by an ambient pressure so as to feed pressurized gaseous medium from the pressure container into the chamber when the ambient pressure increases in order to maintain the pressure in the chamber equal to the ambient pressure;

a frame comprising at least one electrical power inlet, at least one electrical power outlet and a power distribution chamber;

wherein a respective circuit breaker accommodated in said canister chamber is electrically connected to a respective associated power inlet and power outlet via electrical connections extending through the power distribution chamber.

2. The subsea arrangement according to claim 1, wherein the chamber of the respective canister is separated from the power distribution chamber by a zero differential pressure barrier.

3. The subsea arrangement according to claim 1, wherein the bower distribution chamber is filled with a dielectric medium.

4. The subsea arrangement according to claim 3, wherein the bower distribution chamber is volume compensated.

5. The subsea arrangement according to claim 1, wherein the bower distribution chamber is pressure balanced.

6. The subsea arrangement according to claim 1, wherein the power distribution chamber is housed in a soft tank.

7. The subsea arrangement according to claim 1, wherein the pressure balancer is capable of balancing the pressure in the canister chamber against ambient sea water pressure at a sea depth of about 1500-2000 meters.

8. The subsea arrangement according to claim 1, wherein said gaseous dielectric medium is nitrogen or a mixture of nitrogen and $SF_6$.

9. The subsea arrangement according to claim 4, wherein the power distribution chamber is volume compensated to the ambient sea.

10. The subsea arrangement according to claim 5, wherein the power distribution chamber is pressure balanced against ambient sea water pressure.

* * * * *

UNITED STATES PATENT AND TRADEMARK OFFICE

CERTIFICATE OF CORRECTION

PATENT NO. : 8,263,893 B2
APPLICATION NO. : 12/307364
DATED : September 11, 2012
INVENTOR(S) : Tor-Odd Rønhovd It is certified that error appears in the above-identified patent and that said Letters Patent is hereby corrected as shown below:

Claim 3, Col. 4, Lines 25-27:
"3. The subsea arrangement according to claim 1, wherein the bower distribution chamber is filled with dielectric medium"

to

--3. The subsea arrangement according to claim 1, wherein the power distribution chamber is filled with dielectric medium--

Claim 4, Col. 4, Lines 28-29:
"4. The subsea arrangement according to claim 3, wherein the bower distribution chamber is volume compensated"

to

--4. The subsea arrangement according to claim 3, wherein the power distribution chamber is volume compensated--

Claim 5, Col. 4, Lines 30-31:
"5. The subsea arrangement according to claim 1, wherein the bower distribution chamber is pressure balanced"

to

--5. The subsea arrangement according to claim 1, wherein the power distribution chamber is pressure balanced--

Signed and Sealed this
Twenty-ninth Day of January, 2013

David J. Kappos

David J. Kappos
*Director of the United States Patent and Trademark Office*